US008955642B2

(12) United States Patent
Airaksinen et al.

(10) Patent No.: US 8,955,642 B2
(45) Date of Patent: Feb. 17, 2015

(54) WALL STRUCTURE WORKING AS A NOISE BARRIER FOR RAILWAYS AND USE OF THE WALL STRUCTURE AS A NOISE OR PASSAGE BARRIER

(75) Inventors: Jarmo Airaksinen, Vantaa (FI); Janne Tikkamäki, Mäntsälä (FI)

(73) Assignee: Soundim Oy, Vantaa (FI)

( * ) Notice: Subject to any disclaimer, the term of this patent is extended or adjusted under 35 U.S.C. 154(b) by 0 days.

(21) Appl. No.: 13/812,471

(22) PCT Filed: Jul. 26, 2011

(86) PCT No.: PCT/FI2011/050673
§ 371 (c)(1),
(2), (4) Date: Mar. 20, 2013

(87) PCT Pub. No.: WO2012/013860
PCT Pub. Date: Feb. 2, 2012

(65) Prior Publication Data

US 2013/0206502 A1 Aug. 15, 2013

(30) Foreign Application Priority Data

Jul. 26, 2010 (FI) ..... 20105826

(51) Int. Cl.

| | |
|---|---|
| ***E04H 17/16*** | (2006.01) |
| ***E04H 17/14*** | (2006.01) |
| ***E04B 1/82*** | (2006.01) |
| ***E01F 8/00*** | (2006.01) |
| *E04H 17/00* | (2006.01) |

(52) U.S. Cl.
CPC ..... *E04B 1/8209* (2013.01); *E01F 8/0011* (2013.01); *E01F 8/0023* (2013.01)
USPC ..... 181/290; 181/210; 256/26

(58) Field of Classification Search
USPC ..... 181/290, 210, 285, 287; 256/26, 13.1; 105/452; 295/7
See application file for complete search history.

(56) References Cited

U.S. PATENT DOCUMENTS

| | | | | |
|---|---|---|---|---|
| 3,656,576 | A * | 4/1972 | Gubela | 181/210 |
| 5,272,284 | A * | 12/1993 | Schmanski | 181/210 |
| 5,971,096 | A * | 10/1999 | Matsumoto et al. | 181/210 |
| 2010/0243369 | A1 * | 9/2010 | Fusiek et al. | 181/210 |
| 2012/0168244 | A1 * | 7/2012 | Umbricht et al. | 181/210 |

FOREIGN PATENT DOCUMENTS

| | | | | |
|---|---|---|---|---|
| DE | 27 02 257 | A1 | 8/1977 | |
| DE | 3809063 | A1 * | 9/1989 | E01F 8/00 |
| DE | 10 2007 004 022 | B3 | 8/2008 | |

(Continued)

*Primary Examiner* — Edgardo San Martin
(74) *Attorney, Agent, or Firm* — Birch, Stewart, Kolasch & Birch, LLP

(57) ABSTRACT

The object of the invention is a wall structure working as a noise barrier for railways, which comprises at least a plurality of wall elements placed consecutively end-to-end with each other, which wall elements are hinged by means of hinge pieces at their bottom edges for toppling downwards from their vertical position. The wall elements are disposed inside the width reach of the wagons or cargo space of a train and for toppling by means of the hinge pieces to below a wagon or a load that is lower than normal and/or is overwide. The wall structure is suited for use e.g. as a noise barrier or passage barrier for a railway.

16 Claims, 6 Drawing Sheets

(56) References Cited

FOREIGN PATENT DOCUMENTS

| | | | | | |
|---|---|---|---|---|---|
| FI | 8493 | U1 | | 10/2009 | |
| FR | 1300536 | A | | 8/1962 | |
| GB | 2 239 272 | A | | 6/1991 | |
| JP | 08026143 | A | * | 1/1996 | ..... B62D 25/20 |
| JP | 2003129433 | A | * | 5/2003 | ..... E01F 15/02 |
| JP | 2003-201706 | A | | 7/2003 | |
| JP | 2005-248600 | A | | 9/2005 | |
| JP | 2012052312 | A | * | 3/2012 | |
| SE | 353 121 | B | | 1/1973 | |

* cited by examiner

WALL STRUCTURE WORKING AS A NOISE BARRIER FOR RAILWAYS AND USE OF THE WALL STRUCTURE AS A NOISE OR PASSAGE BARRIER

BACKGROUND OF THE INVENTION

1. Field of Invention

The present invention relates to a wall structure working as a noise barrier for railways and use of the wall structure as a noise barrier and/or passage barrier.

2. Description of Related Art

The solution according to the invention is particularly suitable as e.g. a shallow noise barrier for railways, but it is also suitable as a noise barrier for highways and also as a sight barrier for various applications. Owing to its lightness, it can also be used as a temporary barrier for many different applications.

European patent application no. EP1172484 A2 presents one general wall structure constructed on a prior-art principle and working as a noise barrier. It contains a plurality of solid foundation elements, which are manufactured from e.g. concrete, in the direction of the barrier. The foundation elements are disposed in a line consecutively for the length of the fence to be constructed and plate-like elements, which together with the foundation elements form a noise barrier, are fixed onto the top edge of the foundation elements between vertical pillars. In, for example, railway use one concrete foundation element of a corresponding type will weigh thousands of kilograms, so that it is difficult to place into position, and after placing into position it is difficult to move, and moving will succeed only with large machines that might have difficulties gaining access to all the necessary points of a track area. If a noise barrier thus constructed must for some reason, e.g. for overwide carryings or owing to an accident, be quickly removed, this will not always succeed because a large machine for moving a heavy foundation element will not necessarily be immediately available.

Also known in the art are wall structures that work as a noise barrier, in which the part functioning as a noise barrier is disposed between vertical pillars fixed directly into the ground. A problem in these structures is temporary disassembly of the noise barrier when there is, for various reasons, a need for it. Although the section between the pillars could be disassembled easily, the pillars are generally firmly fixed in the soil and, e.g. owing to ground frost, sunk deep into the ground. For this reason it is not easy to take a pillar out quickly, and it might be necessary in an emergency to cut the pillars in order to get them out of the way. In this case re-erecting the barrier is slow and expensive.

A drawback in railway use is that, with the noise barriers that are currently known in the art, any work to service the track at the point of the noise barrier is dangerous because it is not generally worth disassembling the noise barrier during the servicing work, or is it generally feasible. In this case the track section in question must be completely closed to train traffic for safety reasons during the servicing work, which also incurs extra costs.

SUMMARY OF THE INVENTION

The aim of this invention is to reduce and eliminate the aforementioned drawbacks by achieving a lightweight wall structure of a completely new type, which wall structure does not comprise vertical pillars between the wall elements and which wall structure is easy to quickly turn out of the way and, if necessary, is easy to disassemble completely and re-install into its position again. Another aim of the invention is to achieve a versatile, self-supporting structure, which can be modified easily for different applications. Other embodiments of the invention are characterized by what is disclosed in the other claims.

One advantage, among others, of the solution according to the invention is the lightness of the wall structure, in which case the foundation bed can also be lightweight. The foundation bed can be made e.g. by means of screw piles, which screw piles can be freely disposed below the base profile at points in which it is easy to screw them into the ground. In this case the wall structure according to the invention is easy, quick and inexpensive to found and also easy and quick to disassemble, and large machines are not needed as an aid. In connection with disassembly, the screw piles do not even always need to be taken out, but instead it is sufficient when the base profile is detached from the screw piles. Another advantage is improved work safety, because the wall structure can easily be toppled at the point of the servicing work for the duration of the servicing work, and lifted upright again after the work is completed. In this way e.g. the closure of rail traffic during servicing work can be avoided. The easy and quick toppling of the wall structure also makes it possible in an emergency situation in a wide railway yard to gain quick access to an object, e.g. to a burning train, by toppling the barriers encountered.

Owing to the toppling of the wall structure, it is also easy to arrange overwide railway carryings, because a wall structure can be toppled such that overwide wagons or carryings can be transported over the toppled wall structure. In this case nothing needs to be disassembled. An advantage is also the adaptability and diversified usage possibilities of the wall structure. The wall structure can also be used as a temporary barrier for many different applications. Likewise, another advantage is the use of a hollow base profile e.g. as a protective cable channel, which is needed inter alia, in railway use. Another advantage is that all the materials of the wall structure are recyclable. If a part of some structure is damaged, it can easily be replaced with a new one and the damaged part delivered for recycling.

BRIEF DESCRIPTION OF THE DRAWINGS

In the following the invention will be described in more detail by the aid of one example of its embodiment with reference to the attached drawings, wherein.

DESCRIPTION OF EMBODIMENTS

Figure 1:
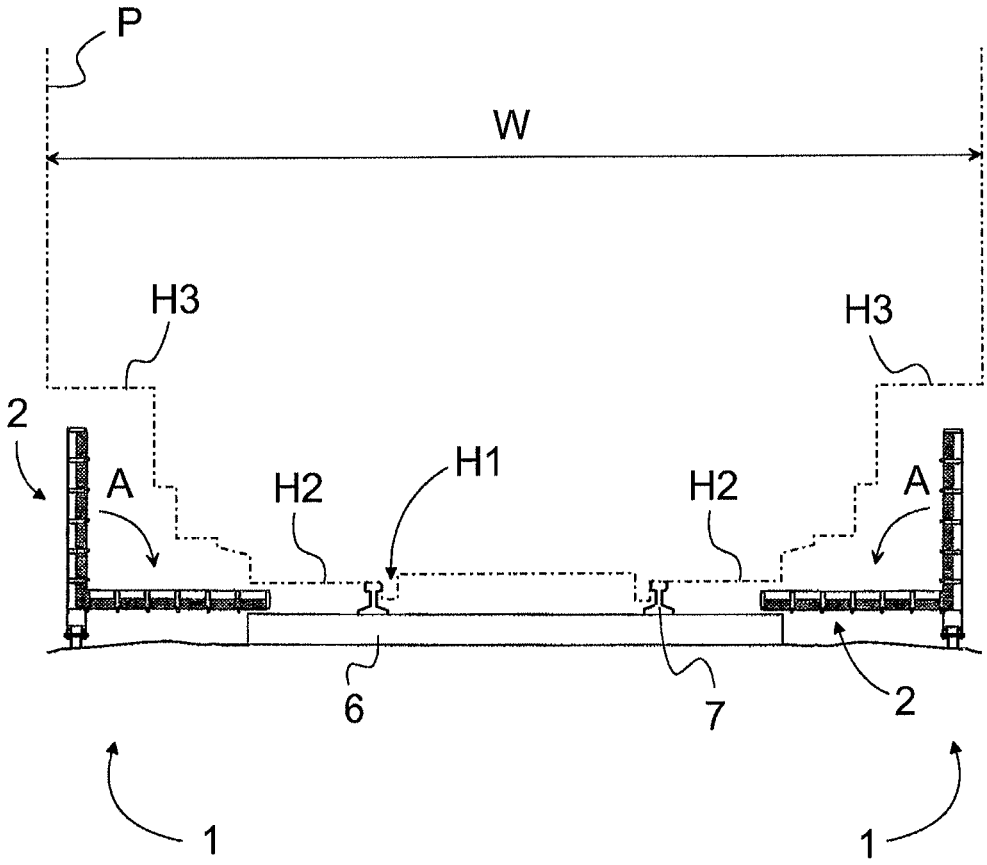
FIG. 1 presents the use of a wall structure according to the invention as a noise barrier for a railway, as viewed in the direction of travel of the track and with the travel profile of the wagon or load presented as a dot-and-dash line.
Figure 1A:
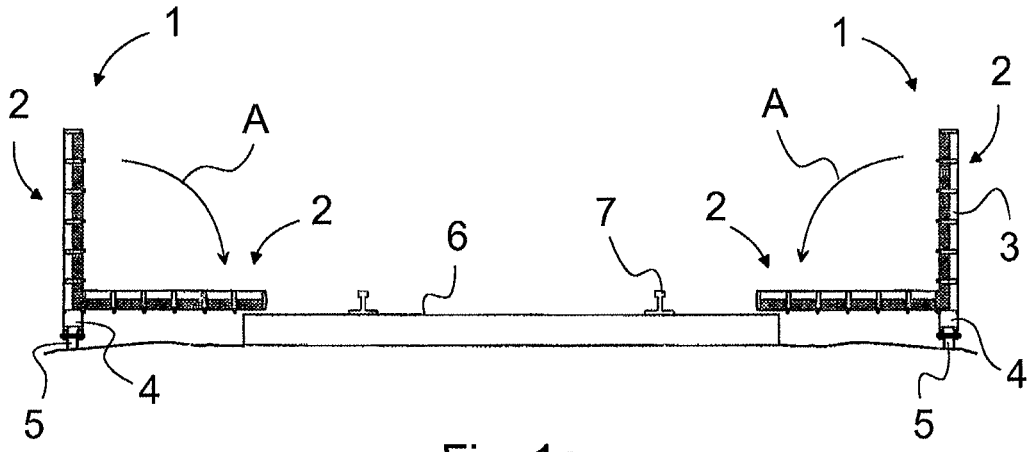
FIG. 1*a* presents the use of a wall structure according to the invention as a noise barrier for a railway, as viewed in the direction of travel of the track.

FIGS. 1 and 1*a* present the use of a wall structure 1 according to the invention as a noise barrier for a railway. In FIG. 1 a part of the profile P of the path of travel of the wagon or load of a train can be seen, in addition to the track structures and barrier structures, which profile is marked in FIG. 1 with a dot-and-dash line. In FIG. 1*a* the profile P not presented.

The profile P of the path of travel of the wagon or load of a train presented in FIG. 1 with a dot-and-dash line corresponds to the so-called "tunnel cross-sectional area" (ATU), which is a certain defined profile inside which there may not be any unauthorized objects. The widest point of the profile P in the horizontal direction is the width reach W, which refers to the widest cross-sectional space used by the wagons or cargo space when they are travelling. The lowest point of the profile P is the space H1 used by the flanges of a wheel of the train, which space is inside the rails of the rail pair 7 and therefore is not critical in terms of its height position in relation to the wall structure 1 of the noise barrier.

Correspondingly, the lowest height of the point H2 of the profile P outside the rails of the rail pair 7 is pertinent from the viewpoint of the solution according to the invention, because the thickness of the wall elements 2 of the wall structure 1 is fitted to be such that the wall element 2 toppled downwards towards the track according to the arrow A remains below the lowest point H2 of the profile P outside the rails of the rail pair 7, i.e. outside the tunnel cross-sectional area (ATU), even if the wall element 2 were to topple onto the top of the railway sleepers.

The profile P presents the tunnel cross-sectional area (ATU) in a normal situation, in which case the permitted bottom clearance of the profile P rises progressively to be higher towards the edges of the profile P. The highest permitted height H3 of the bottom clearance is at both edges of the profile P. The wall structure 1 according to the invention is dimensioned such that it fits to be vertical below the space H3 and inside the width reach W of the profile P, in which case the horizontal distance between the wall structures 1 on different sides of the rail pair 7 is smaller than the width reach W of the profile P.

In overwide and low special carryings some point of the wagon or load can be lower than the bottom surface of the space H3 and extend in the width direction to outside the wall structures 1. In this case the wall elements 2 of the wall structure 1 must be toppled out of the way of the special carrying e.g. exactly onto the railway sleepers, in which case the special carrying, which may not have a lowermost point below the surface of the space H2, fits to travel over the toppled wall elements 2.

The ability to topple the wall structure 1 and the dimensioning of same makes it possible for the wall structure 1 to be disposed inside the width reach W of the profile P, in which case therefore overwide and low special carryings also are possible on the section of track in question, and the fences do not need to be cleared from their path.

In the solution according to the invention a wall structure 1 with its wall elements 2, which works as a noise barrier, e.g. as a shallow noise barrier, is disposed to rest on the railway sleepers 6 on both sides of an installed rail pair 7 so as to be essentially in the direction of the rail pair. Wall elements 2 fitted consecutively end-on-end together with possible door elements 2*a* thus form a wall structure 1 of the desired length. A door element 2*a* is presented in FIG. 3. A door element 2*a* can be essentially similar in its structure to a wall element 2, but a door element 2*a* is shorter in its length than a wall element 2.

One wall element 2 comprises a plurality of profile elements 3 that are essentially similar to each other, which are disposed one on top of another for manufacturing a wall structure 1 of the necessary height. There are e.g. 2, 3, 4, 5, 6, 7, 8 or more units of profile elements 3 one on top of another. One profile element 3 can also be prefabricated to be of the necessary height, in which case a whole wall element 2 is formed from one profile element 3. Each profile element 3 is preferably of extruded metal, e.g. of aluminium or of an alloy of it.

The wall elements 2 are hinged at their bottom part, i.e. from the lowermost of their profile elements 3, to the top edge of a base profile 4 that is essentially U-shaped in its cross-section such that each wall element 2 can be independently turned around its hinge into a lower position. Also the base profile 4 is preferably of extruded metal, e.g. of aluminium or of an alloy of it. The wall structure 1 is disposed with respect to the height of the wall elements 2 and to the railway sleepers 6 such that a wall element 2 lowered downwards in the direction of the arrow A is essentially in a horizontal position and rests at its top end on top of the ends of the railway sleepers 6. The thickness of the wall elements 2 is selected such that overwide wagons and carryings can drive over the toppled wall elements 2.

The wall structure 1 according to the invention, with its base profile 4, is lightweight, in which case it can be founded in a structurally light manner, e.g. on screw piles 5 which are disposed at suitable points below the base profile 4. The screw piles 5 are disposed in the ground e.g. at regular intervals, but if necessary they can also be disposed in points at intervals of freely selectable length, in which points it is easy to screw them into the ground. When the opportunity arises the base profile 4 can be fixed to its foundation also in another manner in addition to, or instead of, the screw piles 5, e.g. to a prefabricated concrete foundation if one is in a spot suitable for using for the fixing of the base profile 4. From the viewpoint of the solution, what is essential is that the base profile 4 can, if necessary, be detached easily and that the fixing points of the base profile 4 in the longitudinal direction of the structure are not precisely predetermined.

Figure 2:
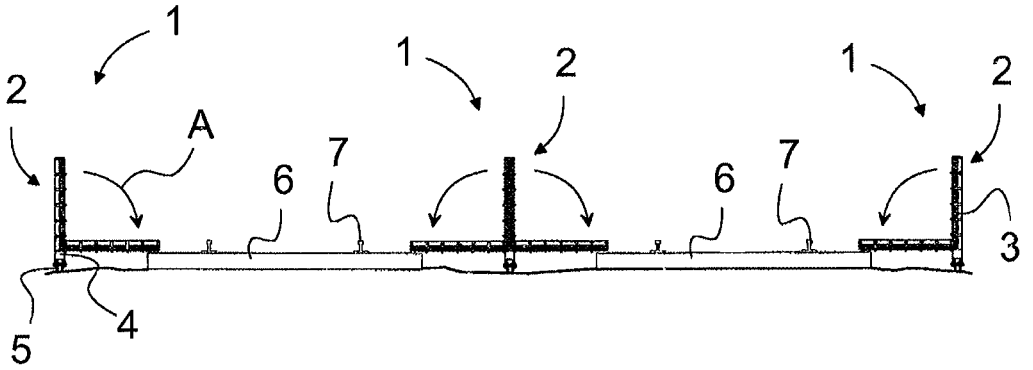
FIG. 2 presents the use of a wall structure according to the invention as a noise barrier for a railway, in connection with two parallel rail pairs and as viewed in the direction of travel of the track.

FIG. 2 presents a wall structure 2 corresponding to the solution of FIGS. 1 and 1*a*, said wall structure to be used as a noise barrier for a railway, used in connection with two parallel rail pairs. In this solution, in addition to the wall structures 1 on the outside edges of the track line, a wall structure 1 working as a noise barrier is also between the rail pairs. The wall structure 1 that is between the rail pairs can be structurally similar to the wall structures 1 that are on the outside edge of the track line, and the wall elements 2 of it can be toppled alternately towards one rail pair and alternately towards the other rail pair in the direction of the arrows A.

Figure 3:
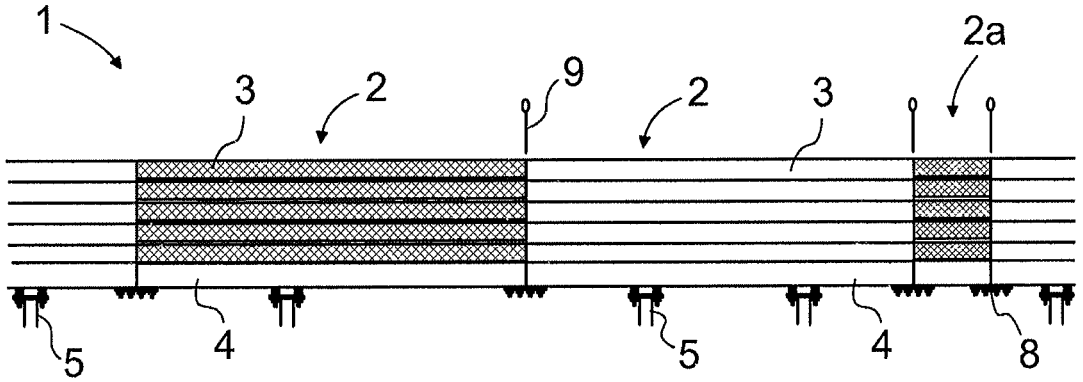
FIG. 3 presents a side view of a wall structure according to the invention.

FIG. 3 presents a side view of a part of a wall structure 1 according to the invention. From the viewpoint of good support, it is advantageous to dispose the wall elements 2 consecutively such that every second wall element is hinged from inside the track line and every other from outside the track line. For example, the wall elements seen in the figure are disposed such that when viewing the wall structure 1 from outside the track line the shaded wall element 2 and door element 2*a* can be toppled towards the viewer away from the track line, whereas every second, lighter, wall element 2 can be toppled away from the viewer towards the track line. The consecutive wall elements 2 are locked to each other at their ends with some suitable locking means 9, such as with a locking pin, which is pulled out of its locking position when the wall elements 2 are toppled. Depending on the situation, the wall elements 2 do not necessarily need to be toppled in different directions. If it is desired that the wall elements 2 are to be toppled in the same direction, they can be provided with a suitable locking mechanism, which fixes the base profile 4 and the bottommost profile element 3 of a wall element 2 to each other. In this case the hinge of the base profile 4 extends on the same side for the length of a number of wall elements 2.

In FIG. 3 the foundation implemented for the screw piles 5 of a base profile 4 as well as the splices 8 of a base profile can be seen. The length of a base profile 4 in the solution according to the example is the same as the length of one wall element 2. Correspondingly, the length of a base profile 4 at the point of a door element 2*a* is the same as the length of the door element 2*a*. A splice 8 of a base profile 4 is e.g. a plate provided with nuts and bolts, which is disposed under the ends of two consecutive end-on-end base profiles 4 and tightened fast to the base profiles 4 with the nuts and bolts. The heads of the bolts are e.g. in T-grooves on the bottom of the base profile 4.

Figure 4:
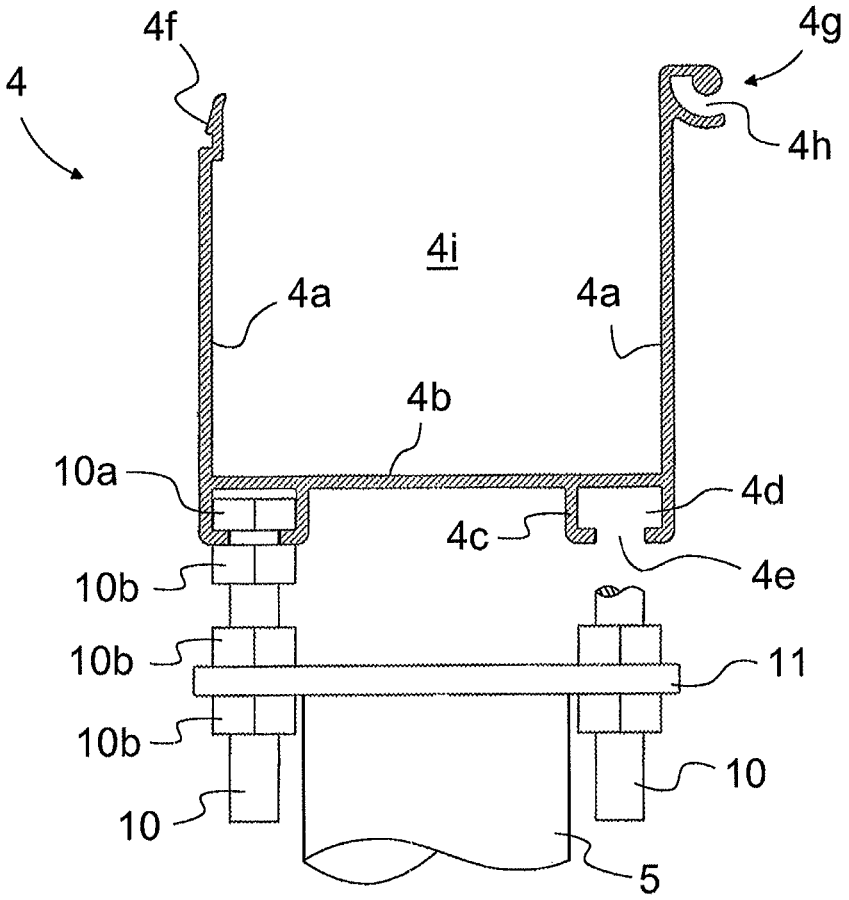
FIG. 4 presents one base profile of a wall structure according to the invention, cross-sectioned and fixed on top of a foundation.

FIG. 4 presents a base profile 4 of a wall structure according to the invention in more detail, cross-sectioned and fixed on top of a foundation formed from screw piles 5. For the sake of clarity, in the figure the fixing bolts 10 on the right-hand side are truncated at their ends. The base profile 4 is a profile manufactured by extruding from aluminium, aluminium alloy or some other suitable material, which profile can be of the length of the wall element 2, or longer or shorter than it. If the base profile 4 is of a different length than the wall element 2, it is advantageous to make the cross-section of the base profile to be symmetrical, so that wall elements that can be turned in different directions can be on top of the same base profile when the junction point of the base profiles 4 and the wall elements are not at the same point. The cross-section presented in FIG. 4 is not symmetrical, so that in this case the length of the base profile 4 must be the same as the length of the wall element 2.

The base profile 4 is essentially a U-shaped profile open at its top end and comprises side walls 4*a* that extend upwards and a base part 4*b* between them, which together and with the aid of a wall element 2 disposed above them form a hollow space 4*i* for e.g. a cable channel. Thus one wall of the hollow space 4*i* is a wall element 2 or a door element 2*a*, which when lowered down opens access and when raised up closes access to the hollow space 4*i*.

Below the base part 4*b* are two pairs of protrusions 4*c* that extend downwards and bend to face each other, each of which pairs forms inside it a space 4*d* of T-groove shape and in the longitudinal direction of the base profile 4 for the heads 10*a* of the fixing bolts 10 of the base profile. The first top edge of the base profile 4 comprises e.g. a clip-like shape-locking detent 4*f* for essentially the whole length of the top edge, to which the profile element 3 to be fixed above the base profile 4 can be locked at one of its bottom edges. Correspondingly the second top edge of the base profile 4 comprises a hinge means 4*g* for essentially the whole length of the top edge, to which the profile element 3 to be fixed above the base profile 4 can be hinged at the second of its bottom edges to turn from the vertical position to the essentially horizontal bottom position. The hinge means 4*g* comprises e.g. a downward-curving groove 4*h* that is open at its front edge and is of quarter-circle shape, to which the bottommost profile element 3 of a wall element 2 can be hinged.

The heads 10*a* of the fixing bolts 10 can be normal heads of a screw, in which case the heads must be disposed in the grooves 4*d* by sliding, or the heads 10*a* can be narrower in one direction than the throughput aperture 4*e* of the grooves, in which case the heads 10*a* of the bolts 10 can be pushed in the correct attitude directly through the throughput apertures 4*e* and then turned into their locking position. In addition, the fixing bolts 10 comprise a plurality of tightening nuts and adjustment nuts 10*b*, with which the base profile 4 can be fixed and fitted into the correct spot in an installation plate 11 fixed to the top end of a screw pile 5.

Figure 5:
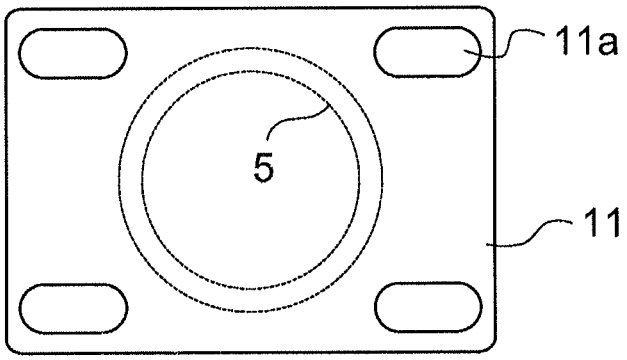
FIG. 5 presents a top view of an installation plate of a base profile according to the invention.

FIG. 5 presents one installation plate 11 of a base profile 4 according to the invention, as viewed from above. The installation plate 11 comprises a plurality of elongated fixing holes 11*a* for the fixing bolts 10. The fixing holes 11*a* enable precise adjustment of the position of the base profile 4 in the lateral direction of the base profile 4 and the fixing bolts 10 enable placement of the base profile in a horizontal attitude even if the screw pile 5 were to be in a slightly inclined position.

Figure 6:
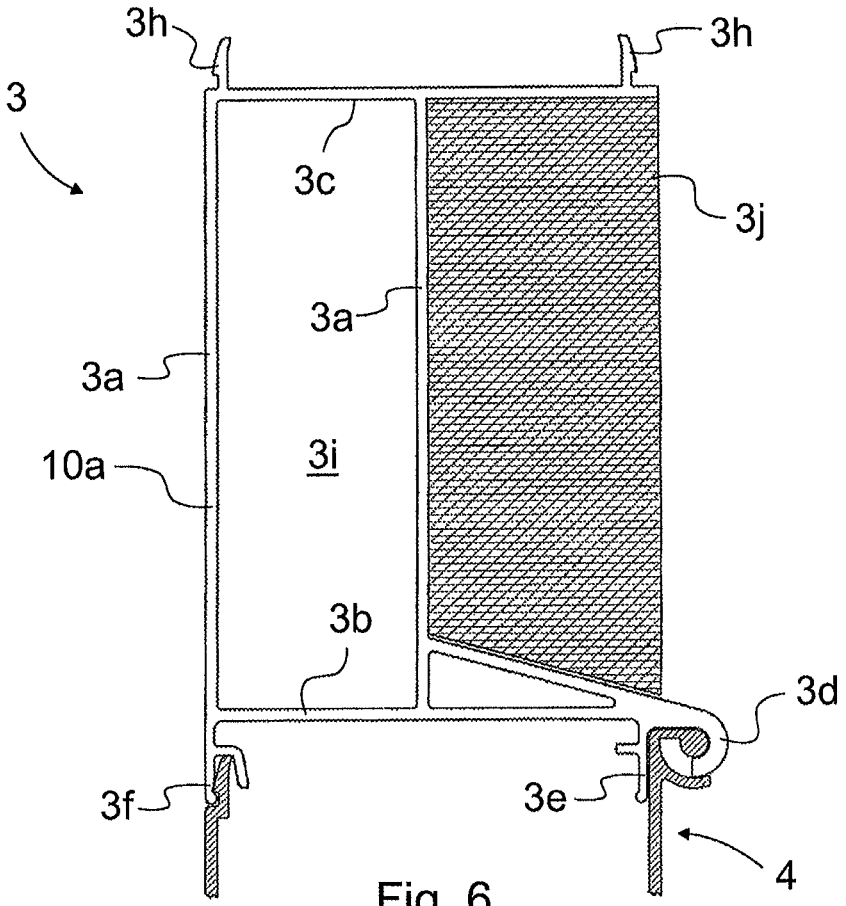
FIG. 6 presents one profile element of a wall structure according to the invention, as viewed from the end.

FIG. 6 presents one profile element 3 of a wall element 2 of a wall structure 1 according to the invention, as viewed from the end. Preferably all the profile elements 3 of a wall element 2 are similar to each other and are extruded from aluminium, aluminium alloy or some other suitable material. The profile element 3 in FIG. 6 is the bottommost element of the wall element 2 and is hinged with a hinge piece 3*d* at its second bottom edge to the hinge means 4*g* of the base profile 4. In addition, the second bottom edge of the profile element 3 comprises e.g. a clip-like shape-locking means 3*e*. Correspondingly, the first bottom edge of the profile element 3 comprises e.g. a clip-like shape-locking means 3*f*, by means of which the profile element 3 can be openably locked at its first bottom edge to the shape-locking means 4*f* on the first top edge of the base profile 4.

The bottommost profile element 3 is essentially similar to all the other profile elements 3 of the wall element 2. In addition to the aforementioned parts 3*d* and 3*f*, the profile element 3 comprises at least a base part 3*b*, vertical walls 3*a* and a top part 3*c*, which together bound the hollow inside space 3*i* of the profile part 3, which inside space is essentially the height of the profile part 3 and about one-half of the total width of the profile part 3. On the other hand, the top part 3*c* and the base part 3*b* are essentially the width of the profile part 3. The hinge piece 3*d* extends to longer than the aforementioned width and forms at the same time rainwater protection for the structure below it.

Both top edges of the profile part 3 comprise e.g. a clip-like shape-locking means 3*h* that is essentially the length of the profile part 3 and extends upwards, to which the profile element 3 to be installed above can be shape-locked with the shape-locking means 3*e* and 3*f* on its bottom edges. A sound-absorbing noise insulator 3*j* is fixed into the open space between the top part 3*c* and the base part 3*b* of the profile element 3, alongside the hollow space 3*i*, for improving the noise insulation of the wall structure 1.

Figure 7:
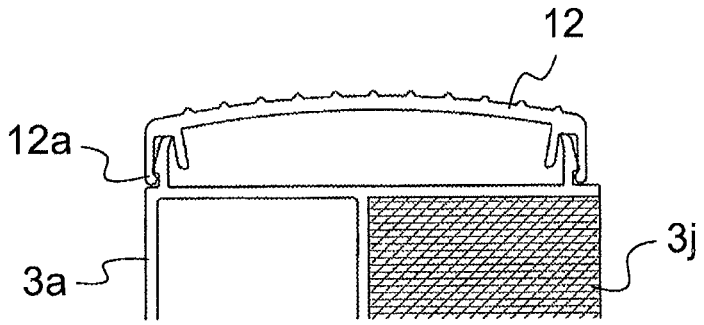
FIG. 7 presents one cover profile of a wall structure according to the invention as viewed from the end.

FIG. 7 presents one cover profile 12 of a wall structure 1 according to the invention as viewed from the end. Both edges of the cover profile 12 comprise e.g. clip-like shape-locking means 12*a*, by the aid of which the cover profile 12 is shape-locked to the shape-locking means 3*h* on the top edge of the topmost profile element 3 of the wall element 2. The cover profile 12 is preferably the length of a wall element 2, but it can also be of another length.

Figure 8:
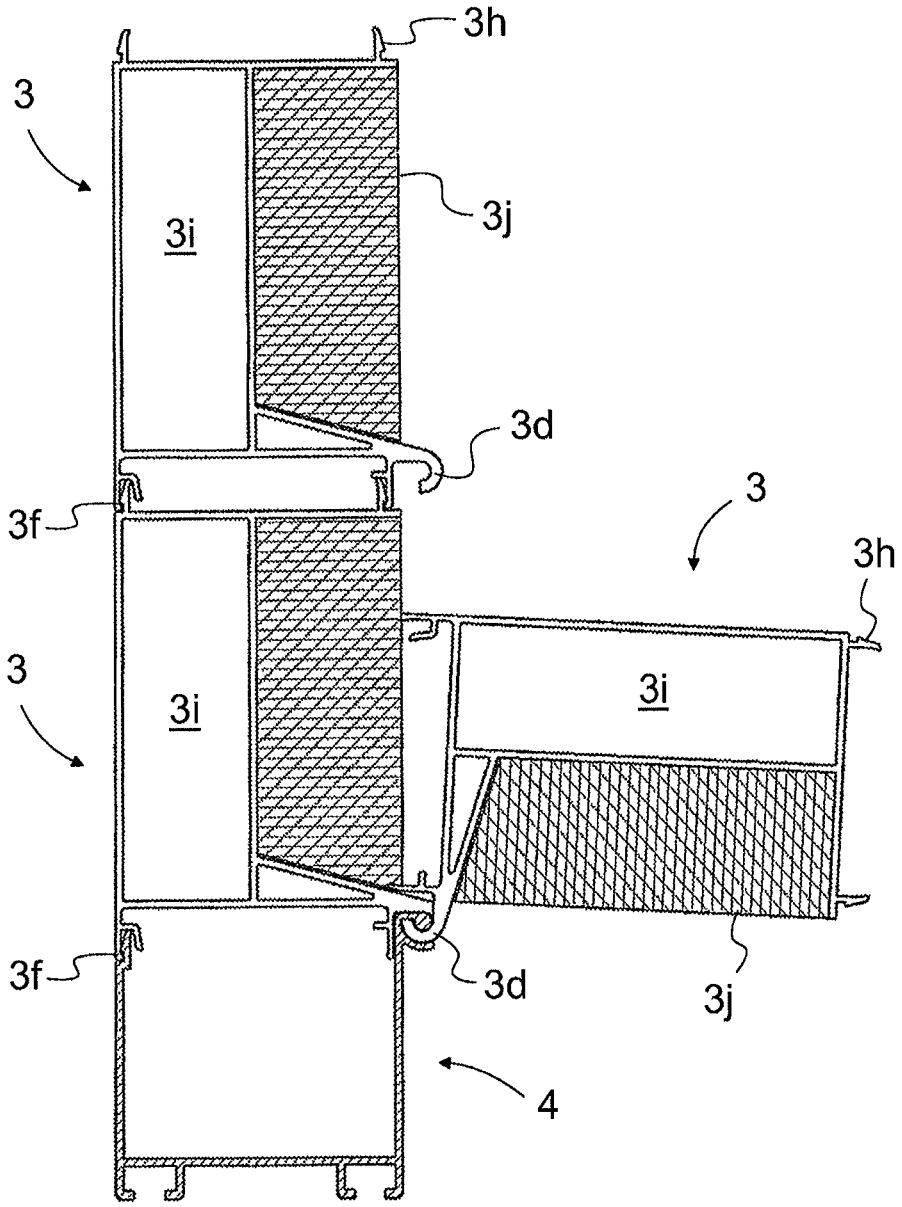
FIG. 8 presents a part of one wall structure according to the invention, as viewed from the end.

FIG. 8 presents the bottom part of one wall structure 1 according to the invention as viewed from the end. Visible in the figure is a base profile 4 and two profile elements 3 fixed on top of it, which profile elements are in a vertical wall element 2, and one profile element 3, which is in a wall element that 2 that has been toppled down. The upper profile elements 3 of the wall elements 2 are not shown in the figure.

Figure 9:
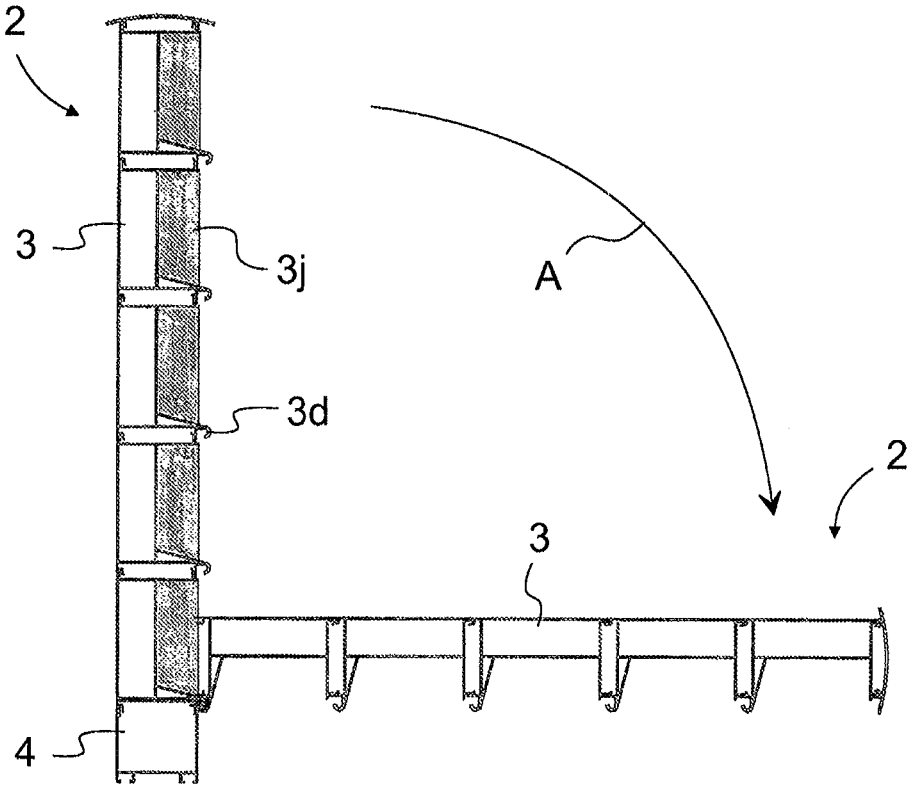
FIG. 9 presents one wall structure according to the invention, as viewed from the end.

FIG. 9 presents one wall structure 1 according to the invention as viewed from the end. The wall element 2 in front has been toppled into its bottom position in the direction of the arrow A and the wall elements 2 that are farther behind are in a vertical position. For the sake of clarity, the figures have been simplified, and e.g. the ground surface and the screw piles are not visible in the figure. In addition, the noise insulators 3*j* are not visible in the wall elements 2 that are toppled over.

Figure 10:
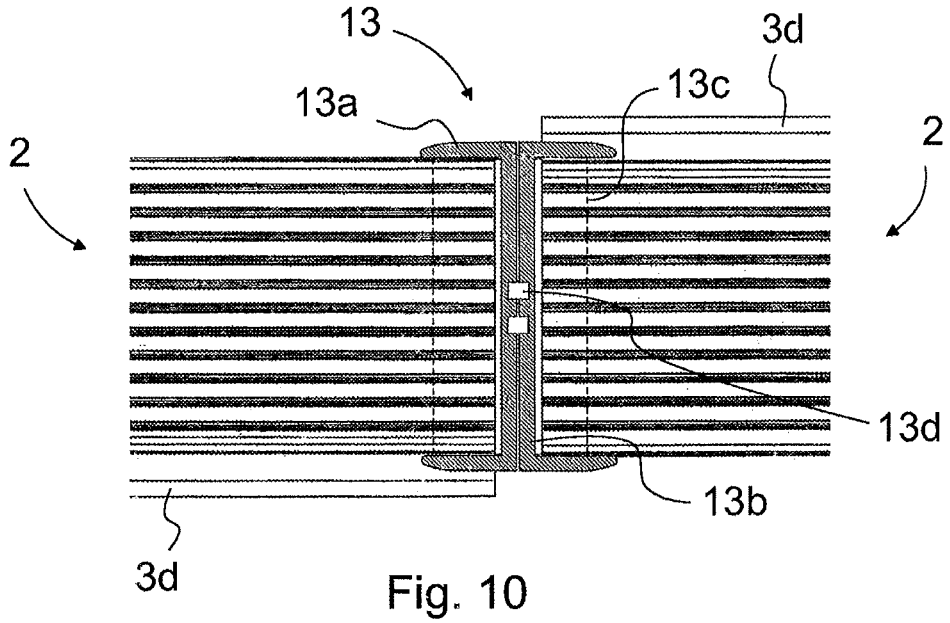
FIG. 10 presents one wall structure according to the invention, as viewed from above.

FIG. 10 presents one wall structure 1 according to the invention as viewed from above. In the figure two wall elements 2 place end-to-end are seen, which wall elements are hinged to turn downwards in opposite directions to each other. In the wall element on the left-hand side the hinge pieces 3*d* are downwards in the figure, and in the wall element on the right-hand side the hinge pieces 3*d* are upwards in the figure In addition, the ends of the wall elements 2 comprise a profile means 13 working as a seal, which extends from the first side to the second side of the wall elements 2, and which comprises on the edges protrusions 13*a* extending in the longitudinal direction of the wall elements 2, which protrusions rest on both side surfaces of the wall elements. In addition, the profile means 13 comprises a transverse wall 13*b* connecting the protrusions.

The profile means 13 is of some suitable elastic material, e.g. rubber, and it can also be fitted to support the wall elements 2 at the ends of the wall elements. The profile means 13 can also be used for locking the wall elements 2 to each other in both the horizontal and vertical direction. In this case the profile means 13 also comprises locking profiles extending from the wall 13*b* in the longitudinal direction of the wall elements 2, the front edge 13*c* of which locking profiles is drawn in FIG. 10 with a dashed line. The locking profiles can be disposed in some suitable hollow space in the profile elements 3. The profile means 13 also functions as a damper of vibration and as a sound insulator.

The locking of consecutive wall elements 2 to each other with the locking means 9, or corresponding, presented in FIG. 3 is implemented with locking grooves 13*d* on the outer surface of the transverse wall 13*b* of the profile means 13, which locking grooves are e.g. rectangular in their cross-sectional shape. The locking means 9 comprises e.g. two downward-pointing branches, the cross-sectional shape of which corresponds to the cross-section formed by two opposing locking grooves 13*d*. Locking is performed by pressing the locking means 9 into the locking grooves 13*d* and correspondingly the locking is opened by lifting the locking means 9 out of the locking grooves 13*d*. Locking can also be implemented in different ways and with different locking means and locking grooves.

It is obvious to the person skilled in the art that different embodiments of the invention are not only limited to the examples described above, but that they may be varied within the scope of the claims presented below. Thus, for example, the structures, shapes, lockings and hinging of the profile elements can also be different to what is presented above.

Additionally, it is obvious to the person skilled in the art that the shape and length of the base profile can be different to what is presented above. The base profile can be e.g. symmetrical in its cross-section such that both of its top edges comprise both a hinge means and a shape-locking means. In this case a wall element can be hinged to a base profile such that it can be toppled downwards in either direction whatsoever, as a consequence of which the length of a base profile does not need to be the same as the length of a wall element, but instead it can be also larger or smaller.

It is also obvious to the person skilled in the art that the wall element according to the invention is suited to many different applications. It can be used as a noise barrier and visual barrier for highways and streets, in addition to railways, and also as a general noise barrier and visual barrier as well as for example, when suitably adapted, as a partition wall of an office or other interior space, and also as a temporary fence structure at various events or in other situations where a fence functioning as a noise barrier or passage barrier is needed as protection.

The invention claimed is:

1. Wall structure working as a noise barrier for railways, which comprises: a plurality of wall elements placed consecutively end-to-end with each other, each wall element is made up of a plurality of profile elements, where one profile element is hinged to a base by means of a hinge piece at its bottom edge and rotatably engaging with a locking mechanism of said base when toppling downwards from a vertical position, wherein the wall elements are disposed inside the width reach of the wagons or cargo space of a train and for toppling by means of the hinge pieces to below a wagon or a load that is lower than normal and/or is overwide.

2. Wall structure according to claim 1, wherein the wall elements are hinged at one of their lower edges to the top edge of a base profile (4) that is constructed to be essentially continuous and is supported on its mounting.

3. Wall structure according to claim 1 or 2, wherein one wall element structure is a door element, which is essentially similar in its structure to a wall element, but is shorter.

4. Wall structure according to claim 1, wherein the base profile is fixed to be supported by piles, such as screw piles, disposed at intervals of freely selectable length.

5. Wall structure according to claim 1, wherein the base profile is a profile open at essentially one of its walls which profile together with the wall element disposed above it is fitted to form an openable and closable hollow space for a cable channel for railways.

6. Wall structure according to claim 1, wherein each wall element of the wall structure comprises a plurality of profile elements that are essentially similar to each other and are fixed with shape locking one on top of another.

7. Wall structure according to claim 1, wherein at least the base profile and the profile elements are manufactured by extruding from aluminium, aluminium alloy or some other suitable material.

8. Use of a wall structure, comprised of wall elements placed consecutively end-to-end with each other and hinged at their bottom edge for toppling, as a noise and/or passage barrier for railways, said barrier bring disposed inside the width reach of the wagons and/or cargo space of a train, each wall element is made up of a plurality of profile elements, where one profile element is hinged to a base by means of a hinge piece at its bottom edge and rotatably engaging with a locking mechanism of said base when toppling downwards from a vertical position.

9. Use of a wall structure according to claim 8, wherein the wall structure is disposed on both sides of a railway such that the wall structure can be turned downwards one wall element at a time by means of said hinge pieces on the bottom edge of said wall element, either in the direction of the railway or away from it, for servicing or for a train to run over.

10. Use of a wall structure according to claim 8 or 9, wherein when using the wall structure as a noise barrier for railways, the wall elements are arranged to be toppled by means of their hinge pieces onto the ends of the railway sleepers such that an overwide wagon or carrying can drive over the toppled wall elements.

11. Use of a wall structure according to claim 8, wherein the wall structure is founded on piles, via a base profile such that when necessary the wall structure, the base profile and the piles can be removed and re-installed.

12. Use of a wall structure according to claim 8, wherein the base profile comprises a hollow space for the cable entries of railways, one wall of which hollow space is the wall structure, which when lowered down opens access and when raised up closes access to the hollow space.

13. Wall structure according to claim 2, wherein the base profile is fixed to be supported by piles disposed at intervals of freely selectable length.

14. Wall structure according to claim 3, wherein the base profile is fixed to be supported by piles disposed at intervals of freely selectable length.

15. Wall structure according to claim 2, wherein the base profile is a profile open at essentially one of its walls which profile together with the wall element disposed above it is fitted to form an openable and closeable hollow space for a cable channel for railways.

16. Wall structure according to claim 3, wherein the base profile is a profile open at essentially one of its walls which profile together with the wall element disposed above it is fitted to form an openable and closable hollow space for a cable channel for railways.

* * * * *